United States Patent [19]

Powell

[11] Patent Number: 4,701,594

[45] Date of Patent: Oct. 20, 1987

[54] COMBINATION MIRROR DEFOGGING AND DRYING DEVICE

[76] Inventor: Paul E. Powell, P.O. Box 674, Bloomfield, N. Mex. 87413

[21] Appl. No.: 921,692

[22] Filed: Oct. 20, 1986

Related U.S. Application Data

[63] Continuation-in-part of Ser. No. 766,437, Aug. 16, 1985, abandoned.

[51] Int. Cl.[4] ..... H05B 1/00

[52] U.S. Cl. ..... 219/219; 34/97; 34/243 R; 219/203; 219/367; 219/370

[58] Field of Search ..... 34/90, 97, 243 R; 98/90; 219/203, 213, 219, 367, 368, 370, 371; 312/227

[56] References Cited

U.S. PATENT DOCUMENTS

| | | | |
|---|---|---|---|
| 2,815,433 | 12/1957 | Zumwalt | 219/219 |
| 3,160,736 | 12/1964 | Catterson | 219/219 |
| 3,384,977 | 5/1968 | Rosenberg | 34/90 |
| 3,449,838 | 6/1979 | Chancellor, Jr. | 34/90 |
| 4,653,201 | 3/1987 | Seaman | 34/90 |

*Primary Examiner*—J. R. Scott
*Assistant Examiner*—Jeffrey A. Gaffin
*Attorney, Agent, or Firm*—Fields, Lewis, Pittenger & Rost

[57] ABSTRACT

The problem of fogged mirrors and wet human body parts in a bathroom after bathing is solved by a device that both selectively defogs the mirror and dries human body parts including the hair. One form of device includes a frame portion that supports the mirror while another form attaches to the mirror. Each form has a housing portion defining a pair of defogging passages and a drying passage in flow receiving relation to the defogging passages with the passages being supplied heated air from a common source. Manually operated valves control the flow through defogging manifolds and between the defogging passages and the drying passage through a drying opening. Controls are also provided to regulate the amount of heat, airflow and time of operation.

21 Claims, 19 Drawing Figures

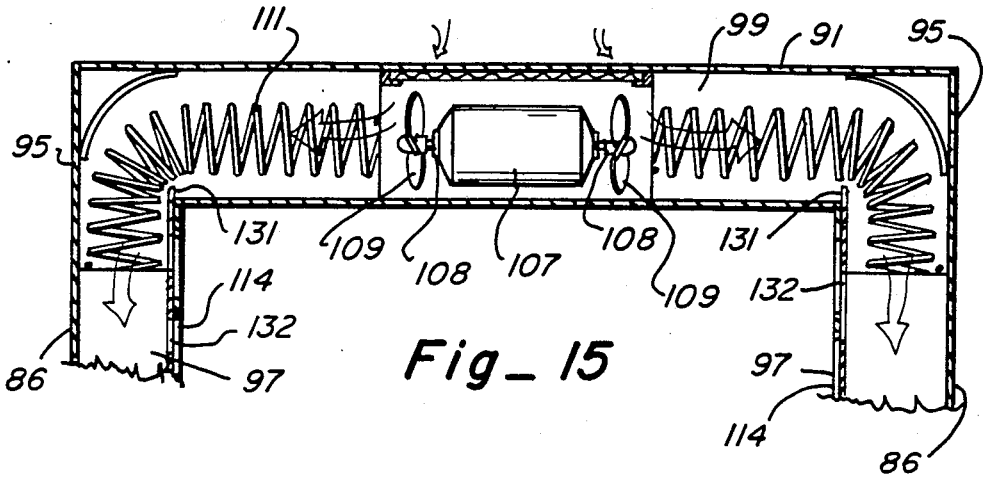
Fig_15
Fig_16
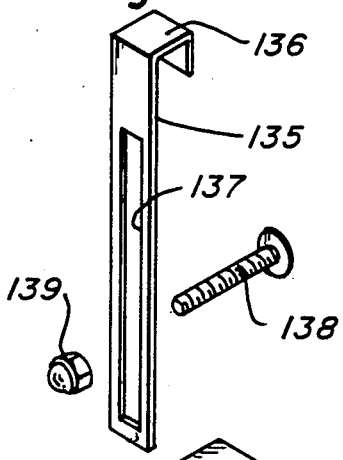
Fig_19
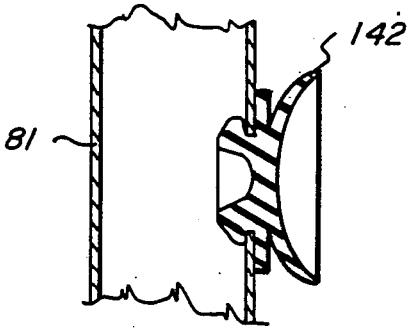
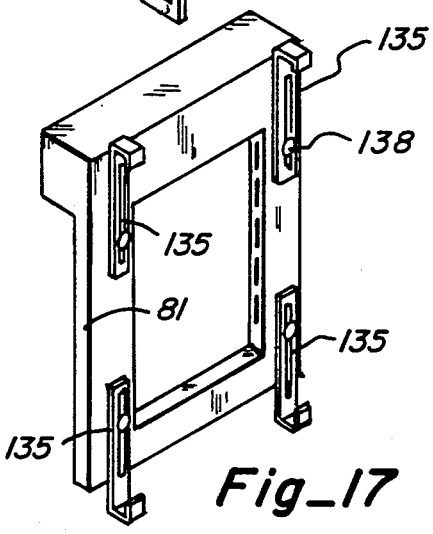
Fig_17
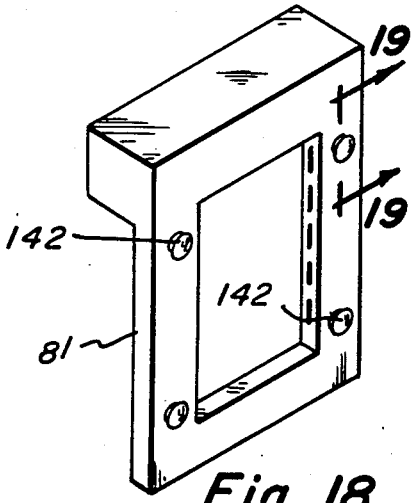
Fig_18

COMBINATION MIRROR DEFOGGING AND DRYING DEVICE

This application is a continuation-in-part of application Ser. No. 766,437, filed Aug. 16, 1985, which is now abandoned.

TECHNICAL FIELD

This invention relates generally to air distributing apparatus and more particularly to a novel and improved device for defogging a mirror and for drying.

BACKGROUND ART

A common problem in the bathroom is the collection of moisture on the mirror, making it obscured to use. There is also a need to dry the body parts, including the hair, after bathing. A number of devices have been provided using a stream of heated air directed over the mirror to defog the mirror, as are illustrated in U.S. Pat. Nos. Re. 18,240, Brown, 1,465,292, Wessig, 2,617,701, Fennell, 3,384,977, Rosenberg, and 4,037,079, Armbruster. Hair dryers are also available as a separate unit.

Such prior air apparatus has disadvantages in the manner in which the air is delivered to the mirror and the airflow is controlled. There is no known single device that uses the same heated air source as a means for defogging the mirror and for drying hair, body parts, and the like.

DISCLOSURE OF INVENTION

The combination mirror defogging and drying device has a member associated with a mirror including a frame portion for bordering the mirror, and a housing portion in which heated air is generated and selectively distributed through defogging openings adjacent the sides of the mirror and through a drying opening downstream of the defogging openings to dry hair, body parts and the like. Controls on a front panel are provided to selectively regulate air flow to either side of the mirror and the drying opening as well as control the amount of heat, amount of airflow and the time of operation. In one embodiment there is a support body adapted to be secured between a pair of wall studs or the like that supports the mirror and in another embodiment there is an attachment to the mirror.

BRIEF DESCRIPTION OF DRAWINGS

The details of this invention will be described in connection with the accompanying drawings, in which:

FIG. 15 is a sectional view taken along lines 15—15 of FIG. 14;

FIG. 16 is a perspective view of a mounting bracket and bolt fastener for the device shown in FIGS. 12 to 15.

FIG. 17 is a rear perspective view of the device shown in FIG. 12 without the mirror.

FIG. 18 is a rear perspective view of the device of the form shown in FIG. 12 with an alternative means of fastening to the mirror; and FIG. 19 is a sectional view taken along lines 19—19 of FIG. 18.

DETAILED DESCRIPTION

Figure 1:
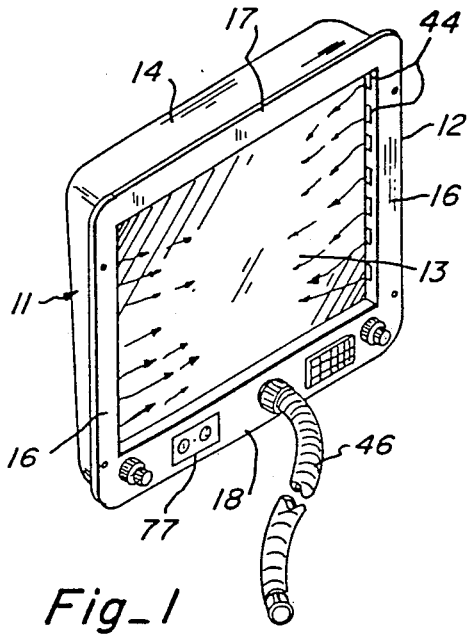
FIG. 1 is a front perspective view of one form of a device embodying features of the present invention.
Figure 2:
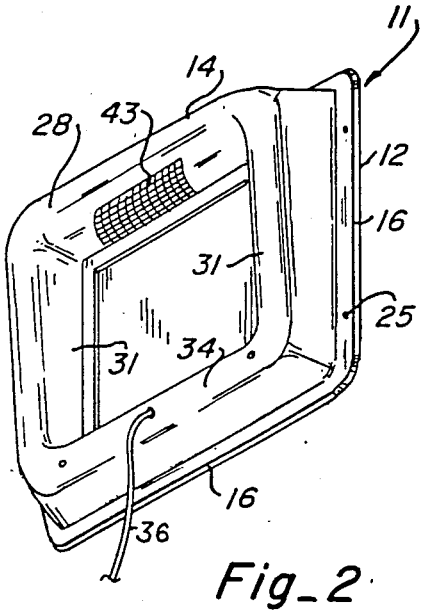
FIG. 2 is a rear perspective view of the device shown in FIG. 1.
Figure 3:
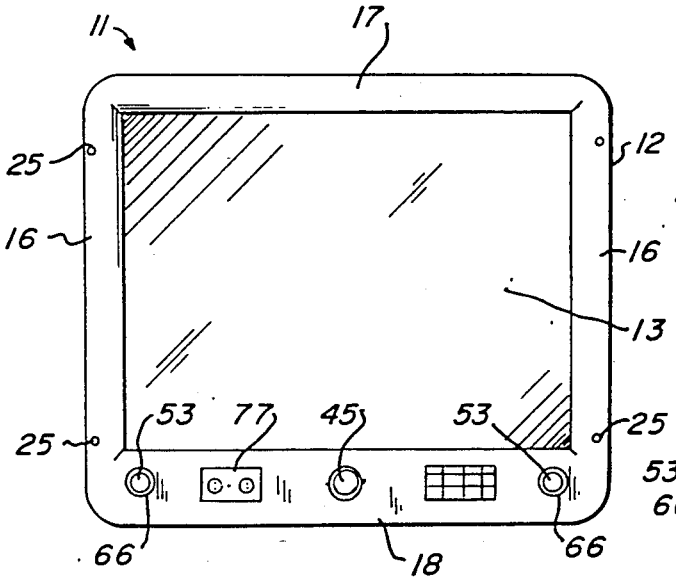
FIG. 3 is a front elevational view thereof.
Figure 4:
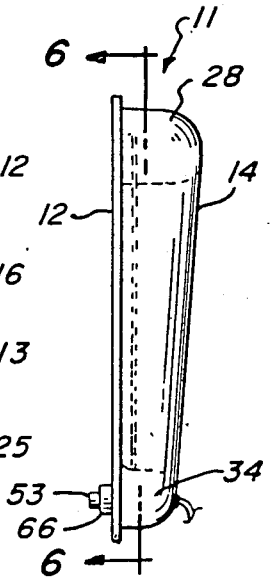
FIG. 4 is a side elevational view thereof.

Referring now to FIGS. 1 to 11 of the drawings, there is shown one embodiment of a mirror defogging and drying device having a member 11 adapated to support the mirror which includes a front frame portion 12 supporting a mirror 13 and a back housing portion 14 integral with portion 12 in which heated air is produced and directed to points of use which are described more fully hereinafter.

The front frame portion 12 is of an open frame construction and has a pair of side panels 16, a top panel 17, and a bottom panel 18 connected together at the corners and bounding a central open area. The cross section of each side panel 16, as viewed from the top, includes a front section 21, a rearwardly extending flange section 22, and an inset section 23.

The mirror is seated on and secured to a pair of oppositely disposed inset sections 23 so that the mirror is recessed within the front of the front frame housing portion 12. The front section has holes 25 through which suitable fasteners 26 extend to secure the device to suitable supports such as between a pair of wall studs or the like.

The back housing portion 14 includes a top back section 28 that forms with top panel 17, a top passage 29, side back sections 31 that form, with respective side panels 16 a pair of side passages 32, herein referred to as defogging passages, and a bottom back section 34 that forms with bottom panel 18 a bottom passage 35, herein referred to as the drying passage. These back sections 28, 31, and 34 are of a generally U-shaped cross section. The side passages converge such that they decrease in crossection from the inlet end to the discharge end to provide a more uniform air flow through the defogging manifold. In practice the frame portion 12 and housing portion 14 can be constructed as a one-piece molded body made of plastic or the like.

A source of heated air shown includes an electric motor 37 centered in the top passage 29 having shafts 38 that extend out from opposite ends of the motor. Each shaft has a squirrel cage type rotor 39 mounted thereon. Each rotor 39 has an imperforate outer plate 40 at the intake end and an imperforate center plate 42 at the outlet end so that air is drawn into the end adjacent the motor and discharged at the periphery of the rotor 39, as indicated by arrows. A resistance heater 41, comprised of a plurality of electric resistance coils extremely in the direction of airflow is mounted in passage 29 downstream of the rotor. The airflow pattern is that air is drawn through an inlet 43 in the top back section 28 and through the rotors and past the coils of heater 41 into the side passages 32. The electric motor and heater are provided electric power by line 36.

The heated air is substantially uniformly distributed at the opposite sides of the mirror by providing a series of rectangular shaped openings 44 in each side panel at spaced intervals between the top and bottom ends thereof. In particular, openings 44 are formed in flange section 22 and are herein referred to as defogging openings.

The bottom panel 18 is provided with an opening 45 in the center thereof and has a hose 46 coupled to the opening by a suitable releasable male pipe coupling fixture 47, connected to the bottom panel and surrounding the opening 45, so that the user can direct the dryer air to dry the hair, body parts, and the like. Opening 45 is herein referred to as the drying opening.

A butterfly-type flow control valve 51 is mounted at the lower end of each defogging passage 32 to control the airflow from the defogging passages into the drying passage 35. Each valve 51 is mounted on a control rod 52 having a control knob 53 located at the outer face of the bottom panel 18. The angular position of rod 52 thereby regulates the airflow from a closed position to a range of settings for the valve which in turn regulates the airflow through drying opening 45.

Another control valve arrangement includes a flat slide bar 61 having rectangular shaped openings 62 at spaced intervals between the ends thereof with a guide 63 for holding the slide bar for up-and-down sliding movement along flange section 22 in side passage 32. The position of the slide bar is set by an arm 64, a hollow rotary shaft 65, and a control knob 66 arranged so that when knob 66 is turned in one direction the slide bar moves up and when turned in the opposite direction the slide bar moves down. When openings 62 and 44 are in full alinement, maximum air passes therethrough and when the bar is moved to a maximum position the openings are closed off from airflow. Shaft 65 is provided with a bore through which rod 52 extends so that the two control shafts and knobs are concentrically arranged.

Figure 5:
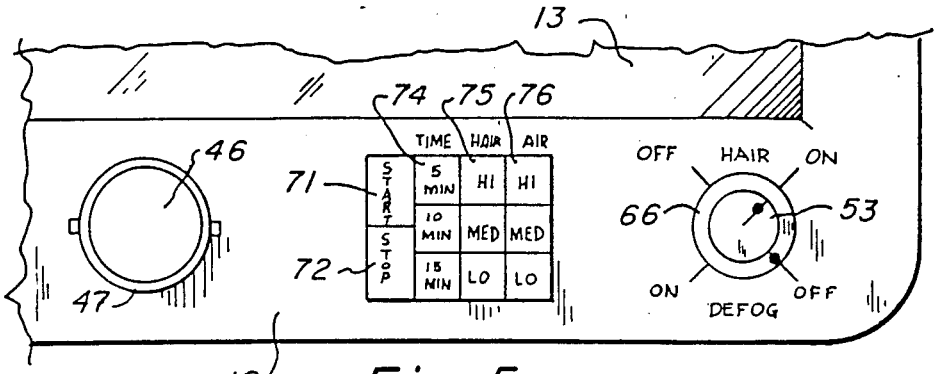
FIG. 5 is a fragmentary front elevational view showing a lower portion thereof.
Figure 6:
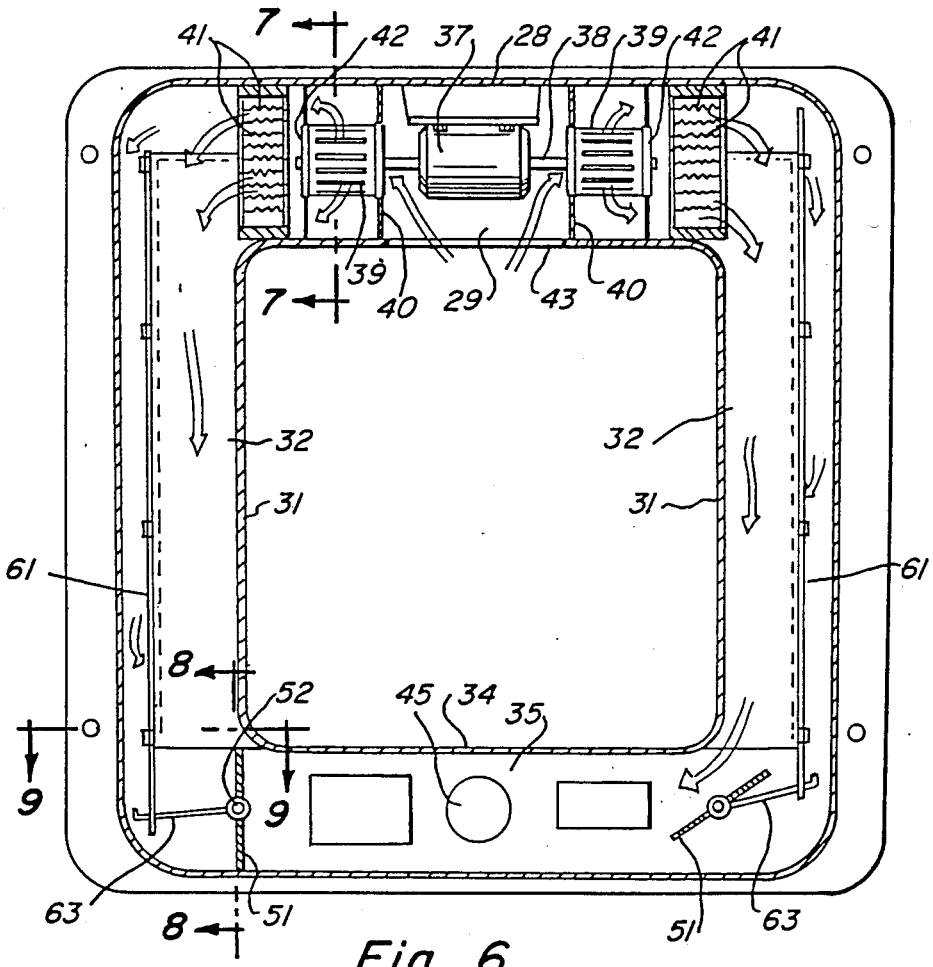
FIG. 6 is a sectional view taken along lines 6—6 of FIG. 4.
Figure 7:
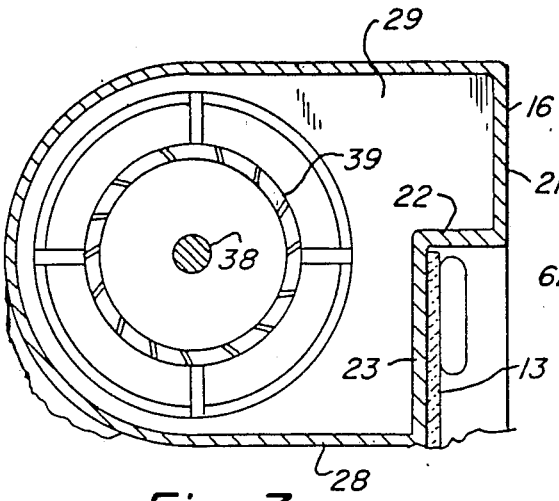
FIG. 7 is a sectional view taken along lines 7—7 of FIG. 6.
Figure 10:
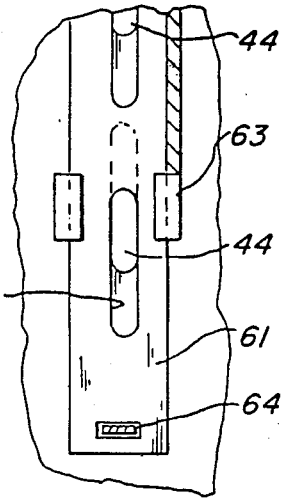
FIG. 10 is a sectional view taken along lines 10—10 of FIG. 9.
Figure 8:
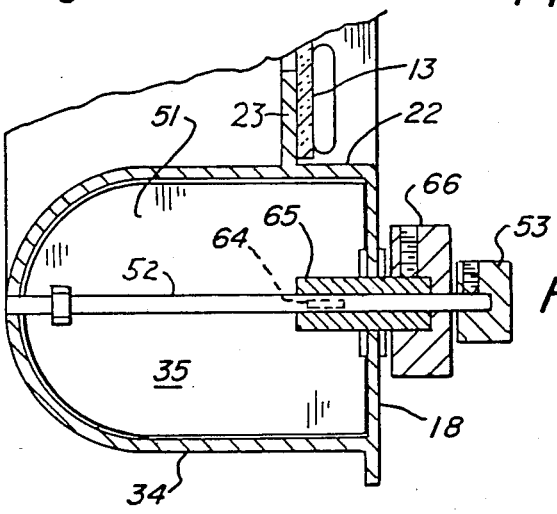
FIG. 8 is a sectional view taken along lines 8—8 of FIG. 6.
Figure 11:
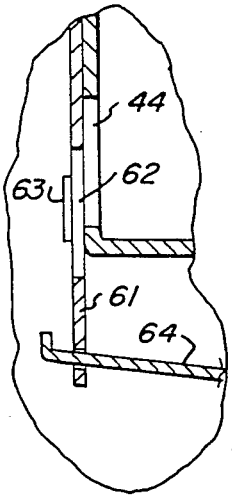
FIG. 11 is a sectional view taken along lines 11—11 of FIG. 9.
Figure 9:
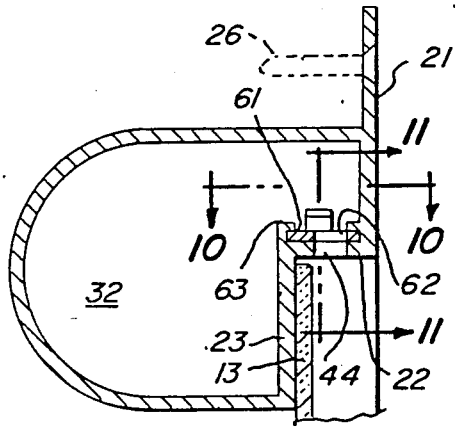
FIG. 9 is a sectional view taken along lines 9—9 of FIG. 6.
Figure 12:
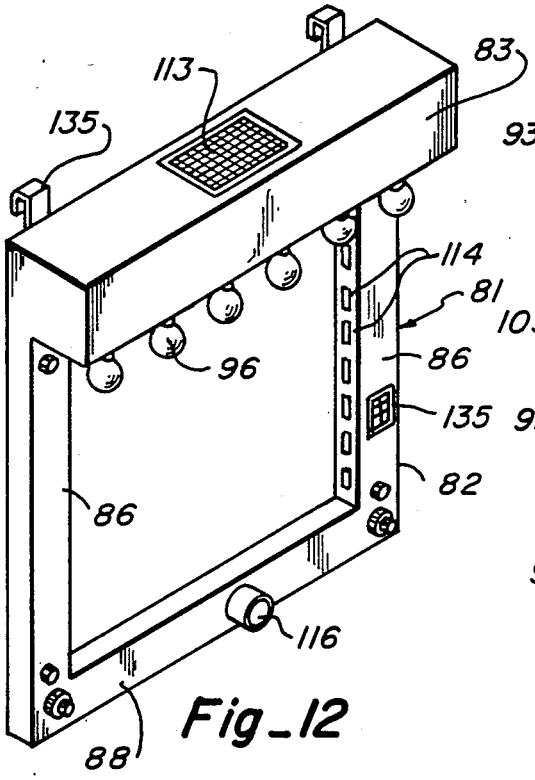
FIG. 12 is a front perspective view of another form of device embodying features of the present invention.
Figure 13:
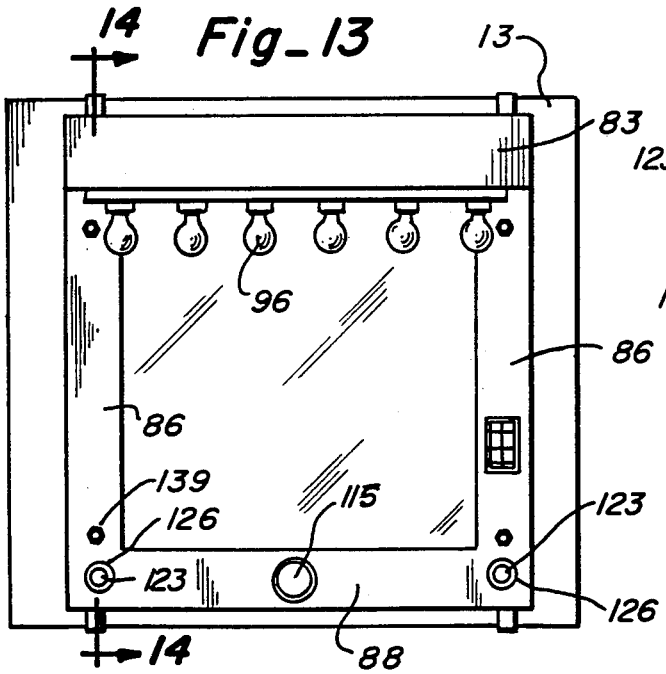
FIG. 13 is a front elevation view of the device shown in FIG. 12.
Figure 14:
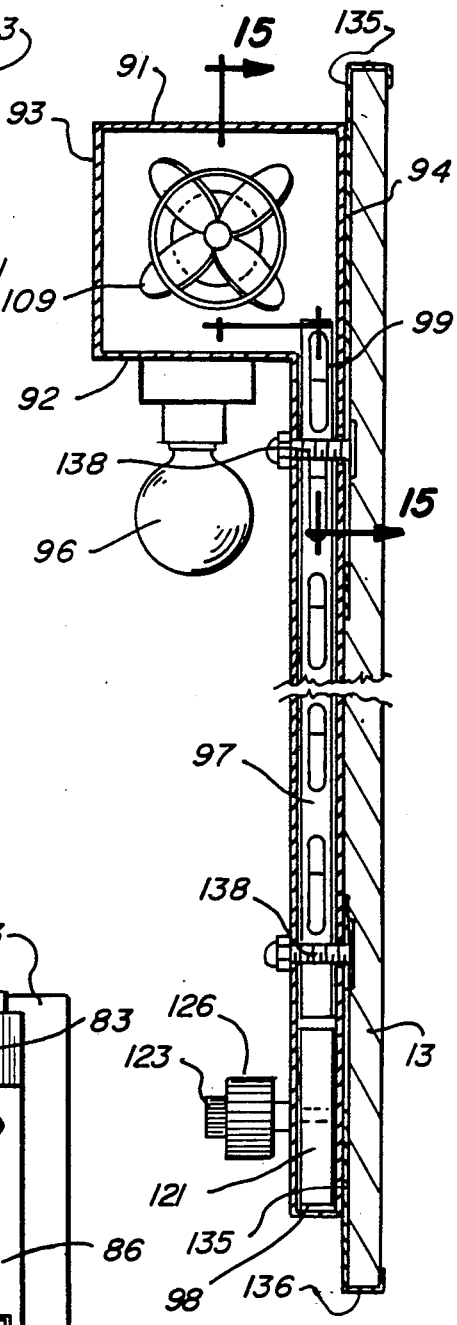
FIG. 14 is a sectional view taken along lines 14—14 of FIG. 13 with the device being attached to a mirror.

As best seen in FIG. 5, the bottom panel carries a control box which includes a stop button 71 and a start button 72 for the motor, timer buttons 74 designated five, ten, and fifteen minutes, to vary the amount of time of motor operation, heat setting buttons 75 designated HIGH, MEDIUM and LOW to select different coil combinations to vary the heat, air setting buttons 76 designated HIGH, MEDIUM AND LOW set the speed of the motor and thereby the amount of airflow delivered. The bottom panel, also carries two electric outlets 77 to accommodate electric shavers, hair curlers, and the like.

In the operation of the above described device the time, heat and air settings are set by selecting buttons 74, 75 and 76 on the control box and pushing start button 71 after the control valves 51 on each side have been set. If no drying is required, the control valves 51 would be set in a closed position and no air would be delivered to the drying passage 35.

Either or both of the valves 51 could be opened by turning knobs 53 and in this way the amount of air through the mirror manifold openings would be reduced. If maximum air for drying were required, the mirror manifold openings would be fully closed and both valves 51 set to the fully opening position. Upon completion of the device the top button 72 would be depressed.

Another embodiment of a mirror defogging and drying device shown in FIGS. 12–17 includes a member 81 adapted to attach to a mirror 13. This member 81 includes a frame portion 82 bordering the mirror and a hollow top housing portion 83 integral with frame portion 82 in which heated air is produced and directed to points of use in the same manner as above described with reference to FIGS. 1–11.

The frame portion 82 has a pair of hollow side panels 86 defining side passages 97, a hollow bottom panel 88 defining a bottom passage 98 and the top housing portion 83 defining a top passage 99. Portion 83 is parallel to and spaced from the bottom panel 88 with the top housing extending forwardly of panels 86 and 88.

The top housing portion 83 includes a top section 91, bottom section 92, front section 93, back section 94 and end section 95 which form the top passage 99 in flow communication with the side passages 97 in side panels 86 and the side passages deliver air to the bottom passage 98. A series of lights 96 are shown mounted on the bottom section to illuminate the mirror.

A source of heated air shown includes an electric motor 107 centered in the top passage 99 having shafts 108 at the ends each of which support a propeller-type fan blade 109. A resistance heater 111 in the form of a coil is shown extending along a portion of the top passage and into the side passage downstream of each blade 109. The airflow pattern is that the air is drawn through an inlet 113 in top section 91 through the fan blades and past the heater coils. The turns of the coil can vary and the coil can be tapered toward the downstream end to change the degree of heating. Also the side passages may be narrowed or tapered as is the case with the form shown in FIGS. 1–11.

The heated air is substantially uniformly distributed at the opposite ends of the mirror by a series of rectangular shaped openings 114 in each side panel at spaced intervals between the top and bottom ends thereof.

The bottom panel 88 is provided with an opening 115 in the center thereof and has a hose coupling 116 adapted to connect to a hose so that the user can direct the dryer air to dry the hair, body parts, and the like.

A butterfly-type flow control valve 121 is mounted at the lower end of each side or defogging passage 97 to control the airflow from the defogging passages into the bottom or drying passage 98. Each valve 121 is mounted on a control rod having a control knob 123 located at the outer face of the bottom panel 88. The angular position of the rod operated by knob 123 thereby regulates the airflow from a closed position to a range of settings for the valve which in turn regulates the airflow through coupling 116.

The control valve arrangement shown includes a flat slide bar 131 having rectangular shaped openings 132 at spaced intervals between the ends thereof with a guide for holding the slide bar for up-and-down sliding movement. The position of the slide bar is set by an arm, a hollow rotary shaft, and a control knob 126 in the same manner as is described with respect to FIGS. 1–11. When knob 126 is turned in one direction the slide bar moves up and when turned in the opposite direction the slide bar moves down. When openings 132 and 114 are in full alinement, maximum air passes therethrough and when the bar is moved to a maximum position the openings are closed off from airflow.

One side panel carries a control box 125 which includes a stop button and a start button for the motor, timer buttons, etc. similar to those described with respect to FIGS. 1–11.

The member 81 attaches to the mirror by means of brackets 135 each having a channel-shaped upper end portion 136 and an elongated slot 137 through which a bolt 138 extends. The bolt extends through the side panel and has a nut 139 that locks the bracket firmly in place to fasten the member 81 to the mirror. Four of the brackets are shown arranged as upper and lower sets to grip upper and lower edges of the mirror, respectively on opposite sides of a vertical center line of the mirror.

An alternate fastening arrangement shown in FIGS. 18 and 19 is the provision of four suction cups 142 in place of the above described brackets 135, the suction cups being fastened to the rear wall of the side panels.

Although the present invention has been described with a certain degree of particularity, it is understood that the present disclosure has been made by way of example and that changes in details of structure may be made without departing from the spirit thereof.

What is claimed is:

1. A combination mirror defogging and drying device comprising:

a member including a frame portion for bordering a mirror and a housing portion containing a source of heated air, said housing portion having a pair of oppositely disposed defogging passages arranged for receiving heated air from said source and supplying heated air through at least one defogging manifold portion having a series of spaced defogging openings arranged to defog the mirror, and a drying passage in flow-receiving relation to said defogging passages having a drying opening through which heated air is discharged;

first control means for regulating the flow through said series of defogging openings from a closed position to a range of opening sizes to control the airflow over the mirror; and second control means for regulating the flow of air from each of said defogging passages to said drying passage and for varying the airflow that is discharged from said drying opening.

2. A device as set forth in claim 1 wherein said member is a support body for supporting a mirror.

3. A device as set forth in claim 1 wherein said member is an attachment to a mirror.

4. A device as set forth in claim 3 wherein said member has brackets which fasten to opposite edges of a mirror.

5. A device as set forth in claim 3 wherein said member has suction cups to fasten to the front face of a mirror.

6. A device as set forth in claim 1 wherein said source of heated air includes a motor having shafts extending out from opposite ends, each shaft carrying an air moving rotor arranged to force heated air into said defogging passages.

7. A device as set forth in claim 6 wherein said.rotor is of the squirrel-cage type.

8. A device as set forth in claim 6 wherein said rotor is a propeller-type fan blade.

9. A device as set forth in claim 1 wherein said frame portion includes a pair of side panels, a top panel and a bottom panel connected at the ends at corners forming a central open area, each said side panel including a front section, a flange section and an inset section supporting said mirror in a position recessed behind said front section.

10. A device as set forth in claim 9 wherein said flange sections have a plurality of openings extending along the sides of the mirror to form said defogging manifold portion.

11. A device as set forth in claim 10 wherein first control means includes a slide bar having a plurality of spaced openings slidable along said flange section to regulate the airflow through said defogging openings according to the position of said slide bar along said flange section.

12. A device as set forth in claim 11 wherein said first control means further includes a control shaft mounted on said front frame portion and connected to said slide arm with a control knob for manually turning said control shaft to change the position of said slide bar.

13. A device as set forth in claim 1 wherein said source of heated air is disposed in a top passage extending along the top of said mirror, said defogging passages extend along the sides of said mirror, and said drying opening being centered in the bottom of said bottom passage.

14. A device as set forth in claim 1 wherein said defogging passages converge from a larger cross-sectional dimension to a smaller cross-sectional dimension from an air inlet end to an air outlet end to provide a more uniform airflow through said defogging openings.

15. A device as set forth in claim 1 wherein said second control means includes a flow control valve between the outlet end of each defogging passage and the inlet ends of said drying passage.

16. A device as set forth in claim 15 wherein said second control means further includes a control shaft mounted on said front frame portion and connected to a flow control valve, there being a control knob for manually turning said control shaft for changing the setting of said control valve.

17. A device as set forth in claim 1 wherein said first and second means include control knobs on concentric shafts at the front of said front frame portion.

18. A combination mirror defogging and drying device comprising:

a support body including a front frame portion, and a back housing portion, said front frame portion including:

a pair of side panels, a top panel and a bottom panel connected at the corners to form a central open area, each said side panel including a front section, adapted to be fastened to a support to dispose the support body upright, a flange section, and an inset section, supporting a mirror in a position recessed behind said front section, said flange sections having a plurality of openings along the sides of the mirror forming a defogging manifold portion through which heated air is passed to defog the mirror, said back housing portion including a top back section defining with said top panel a top passage, a pair of side back sections defining with said side panels a pair of defogging passages, and a bottom back section defining with said bottom panel a drying passage;

said bottom passage having a drying opening through which heat is discharged;

a source of heated air in said top passage including a motor having shafts extending out from opposite ends thereof, each shaft carrying an air-moving rotor to force heated air into said defogging passages;

first means to control the size of said openings to regulate the airflow to either side of said mirror; and second means independently operable from said first means to control the flow of air from each of said side passages into said bottom passage and for varying the flow from said side passages through said dryer opening.

19. A device as set forth in claim 18 further including means to vary the time said heated air is delivered, the amount of heat input to said air and the amount of airflow.

20. A device as set forth in claim 18 including a hose coupled to said support body at said drying opening to direct the heated air to a point of use.

21. A combination mirror defogging and drying device comprising:

a member including a frame portion for bordering a mirror and a housing portion containing a source of heated air, said frame portion including a pair of side panels defining defogging manifold portions and a bottom portion defining a drying passage, said housing portion having a pair of oppositely disposed defogging passages arranged for receiving heated air from said source and supplying heated air through said defogging manifold portions, each said manifold portion having a series of spaced defogging openings arranged to defog a mirror behind said member, said drying passage in flow-receiving relation to said defogging passages having a drying opening through which heated air is discharged;

means to releasably fasten said member to a mirror;

first control means for regulating the flow through said series of defogging openings from a closed position to a range of opening sizes to control the airflow over the mirror; and second control means for regulating the flow of air from each of said defogging passages to said drying passage and for varying the airflow that is discharged from said drying opening.

* * * * *